US009671079B2

(12) United States Patent
Honda

(10) Patent No.: US 9,671,079 B2
(45) Date of Patent: Jun. 6, 2017

(54) VEHICULAR HEADLAMP

(71) Applicant: KOITO MANUFACTURING CO., LTD., Tokyo (JP)

(72) Inventor: Takahiko Honda, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 69 days.

(21) Appl. No.: 14/718,706

(22) Filed: May 21, 2015

(65) Prior Publication Data

US 2015/0338047 A1 Nov. 26, 2015

(30) Foreign Application Priority Data

May 23, 2014 (JP) ..... 2014-106760

(51) Int. Cl.
*F21V 13/04* (2006.01)
*F21V 7/09* (2006.01)
*F21S 8/10* (2006.01)

(52) U.S. Cl.
CPC ..... *F21S 48/1388* (2013.01); *F21S 48/1159* (2013.01); *F21S 48/125* (2013.01); *F21S 48/1258* (2013.01); *F21S 48/1352* (2013.01); *F21S 48/1364* (2013.01); *F21S 48/145* (2013.01); *F21S 48/1747* (2013.01); *F21V 13/04* (2013.01)

(58) Field of Classification Search
CPC .. F21S 48/1159; F21S 48/125; F21S 48/1258; F21S 48/1352; F21S 48/1364; F21S 48/1388; F21S 48/145; F21S 48/1747; F21V 13/04
See application file for complete search history.

(56) References Cited

U.S. PATENT DOCUMENTS 7,093,966 B2 * 8/2006 Yamamura ..... F21S 48/1388 362/459
7,186,009 B2 * 3/2007 Yamamura ..... F21S 48/1145 362/297

(Continued)

FOREIGN PATENT DOCUMENTS

CN 1619210 A 5/2005
CN 1865766 A 11/2006
JP 2010-118203 A 5/2010

OTHER PUBLICATIONS

First Office Action issued in corresponding Chinese Application No. 201510262504.5, mailed on Feb. 13, 2017 (14 pages).

*Primary Examiner* — Alan Cariaso
(74) *Attorney, Agent, or Firm* — Osha Liang LLP

(57) ABSTRACT

A vehicular headlamp has a projection lens, a first light source disposed rearward of a rear focal point of the projection lens, a first reflector that reflects emitted light from the first light source above the first light source and toward the projection lens, a shield disposed such that a front end edge of the shield passes through a vicinity of the rear focal point to block a portion of reflected light from the first reflector, a second reflector that is disposed forward of the first reflector, and that reflects the emitted light from the first light source toward a position between the first light source and the shield, and a third reflector that is disposed between the first light source and the shield, and that reflects reflected light from the second reflector toward the projection lens by passing the reflected light below the shield.

6 Claims, 6 Drawing Sheets

(56) References Cited

U.S. PATENT DOCUMENTS

| | | | | |
|---|---|---|---|---|
| 8,425,097 | B2 * | 4/2013 | Yamamoto | F21S 48/1747 362/517 |
| 8,690,405 | B2 * | 4/2014 | Sekiguchi | F21V 13/12 362/514 |
| 9,273,844 | B2 * | 3/2016 | Matsumoto | F21S 48/1388 |
| 2002/0089853 | A1 | 7/2002 | Taniuchi et al. | |
| 2005/0111235 | A1 | 5/2005 | Suzuki et al. | |
| 2006/0262552 | A1 | 11/2006 | Komatsu et al. | |
| 2010/0118559 | A1 | 5/2010 | Nakada | |

* cited by examiner

VEHICULAR HEADLAMP

BACKGROUND

Technical Field

The present invention relates to a projector-type vehicular headlamp with a shield.

Related Art

A projector-type vehicular headlamp is conventionally known which is configured such that light from a light source disposed rearward of a rear focal point of a projection lens is reflected toward the projection lens by a reflector.

Furthermore, such a vehicular headlamp is also known to be configured, in some cases, such that the shield disposed between the light source and the projection lens blocks a portion of reflected light from the reflector to form a low-beam distribution pattern.

Patent Document 1 describes such a vehicular headlamp configured as follows. A second reflector is disposed forward of a reflector and a third reflector is disposed forward of the shield so that the second and third reflectors sequentially reflect emitted light from the light source. Thus, when a low beam is radiated, an overhead sign installed above a road surface located forward of the vehicle is irradiated with the low beam.

Patent Document 1

Japanese Patent Application Laid-Open (Kokai) No. 2010-118203

SUMMARY

In the vehicular headlamp described in Patent Document 1 described above, the third reflector is disposed forward of the shield. Consequently, when reflected light from the second reflector enters the third reflector, the incident angle of the light has a relatively large value. Thus, accurately controlling the direction of reflected light from the third reflector may be difficult and therefore, forming, with high positional accuracy, an additional light distribution pattern allowing the overhead sign to be irradiated with light may be difficult.

When any additional light distribution pattern other than the additional light distribution pattern is formed to allow the overhead sign to be irradiated with light, forming, with high positional accuracy, an additional light distribution pattern allowing the overhead sign to be irradiated with light may be difficult.

One or more embodiments of the present invention may provide a projector-type vehicular headlamp with a shield, which allows an additional light distribution pattern formed above a cut-off line to be formed with high positional accuracy.

One or more embodiments of the present invention may improve the configurations of a second reflector and a third reflector.

A vehicular headlamp according to one or more embodiments of the present invention comprises a projection lens, a first light source disposed rearward of a rear focal point of the projection lens, a first reflector that reflects emitted light from the first light source above the first light source and toward the projection lens, a shield disposed such that a front end edge of the shield passes through a vicinity of the rear focal point to block a portion of reflected light from the first reflector, a second reflector that is disposed forward of the first reflector, and that reflects the emitted light from the first light source toward a position between the first light source and the shield, and a third reflector that is disposed between the first light source and the shield, and that reflects reflected light from the second reflector toward the projection lens by passing the reflected light below the shield. According one or more embodiments of the present invention, the shield is disposed such that the front end edge of the shield passes through the rear focal point to block the portion of reflected light from the first reflector.

The type of the above-described "first light source" is not particularly limited. According to one or more embodiments of the present invention, the specific position, orientation, and the like of the "first light source" are not particularly limited provided that the "first light source" is disposed rearward of the rear focal point of the projection lens.

According to one or more embodiments of the present invention, the specific shape and the like of the above-described "shield" are not particularly limited provided that the shield is configured to block a portion of the reflected light from the first reflector when the front end edge of the shield is disposed so as to pass through the rear focal point of the projection lens or the vicinity of the rear focal point.

According to one or more embodiments of the present invention, the specific location of the above-described "second reflector", the shape of a reflecting surface of the "second reflector", and the like are not particularly limited provided that the second reflector is configured to reflect the emitted light from the first light source toward a position between the first light source and the shield when the second reflector is disposed forward of the first reflector.

According to one or more embodiments of the present invention, the specific location of the above-described "third reflector", the shape of a reflecting surface of the third reflector, and the like are not particularly limited provided that the third reflector is configured to reflect the reflected light from the second reflector toward the projection lens by passing the reflected light below the shield when the third reflector is disposed between the first light source and the shield.

According to one or more embodiments of the present invention, the vehicular headlamp is configured such that light from the first light source disposed rearward of the rear focal point of the projection lens is reflected toward the projection lens by the first reflector disposed above the first light source and such that a portion of the reflected light from the first reflector is blocked by the shield disposed with the front end edge thereof passing through the rear focal point or the vicinity of the rear focal point. Thus, a low-beam distribution pattern with a cut-off line at an upper end of the pattern can be formed.

Moreover, the second reflector is disposed forward of the first reflector, which reflects the emitted light from the first light source toward the position between the first light source and the shield, and between the first light source and the shield, the third reflector is disposed which reflects the reflected light from the second reflector toward the projection lens by passing the reflected light below the shield. Thus, an additional light distribution pattern can be formed above the cut-off line using light sequentially reflected by the second and third reflectors.

Since the third reflector is disposed between the first light source and the shield rather than forward of the shield, the incident angle of the reflected light from the second reflector entering the third reflector can be restricted to a relatively small value. Thus, the direction of the reflected light from the third reflector can be accurately controlled, allowing an additional light distribution pattern to be formed with high positional accuracy.

As described above, in the projector-type vehicular headlamp with the shield according to one or more embodiments of the present invention, the additional light distribution pattern formed above the cut-off line can be formed with high positional accuracy.

According to one or more embodiments of the present invention, the third reflector reflects light to irradiate an overhead sign installed above a road surface located forward of a vehicle. Accordingly, the visibility of the overhead sign can be enhanced by forming the additional light distribution pattern with high positional accuracy.

One or more embodiments of the present invention further comprises a second light source disposed rearward of the rear focal point, and a fourth reflector disposed downward of the second light source to reflect emitted light from the second light source toward the projection lens. Accordingly, a high-beam distribution pattern can be formed by simultaneously turning on the first and second light sources.

Since the third reflector is disposed between the first light source and the shield rather than forward of the shield as in the related art, the reflected light from the fourth reflector can be prevented or restrained from being blocked by the third reflector.

According to one or more embodiments of the present invention, the first and second light sources are supported by a common light source support member, and the third reflector is disposed between the light source support member and the shield. Accordingly, an installation space for the third reflector can be easily secured. Furthermore, the reflected light from the fourth reflector can be more effectively prevented or restrained from being blocked by the third reflector.

BRIEF DESCRIPTION OF THE DRAWINGS

FIG. 1 is a side-sectional view showing a vehicular headlamp according to one or more embodiments of the present invention in which a first light source is turned on.

FIG. 3 is a side-sectional view showing the vehicular headlamp in which a second light source is additionally turned on.

DETAILED DESCRIPTION

Embodiments of the present invention will be described below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
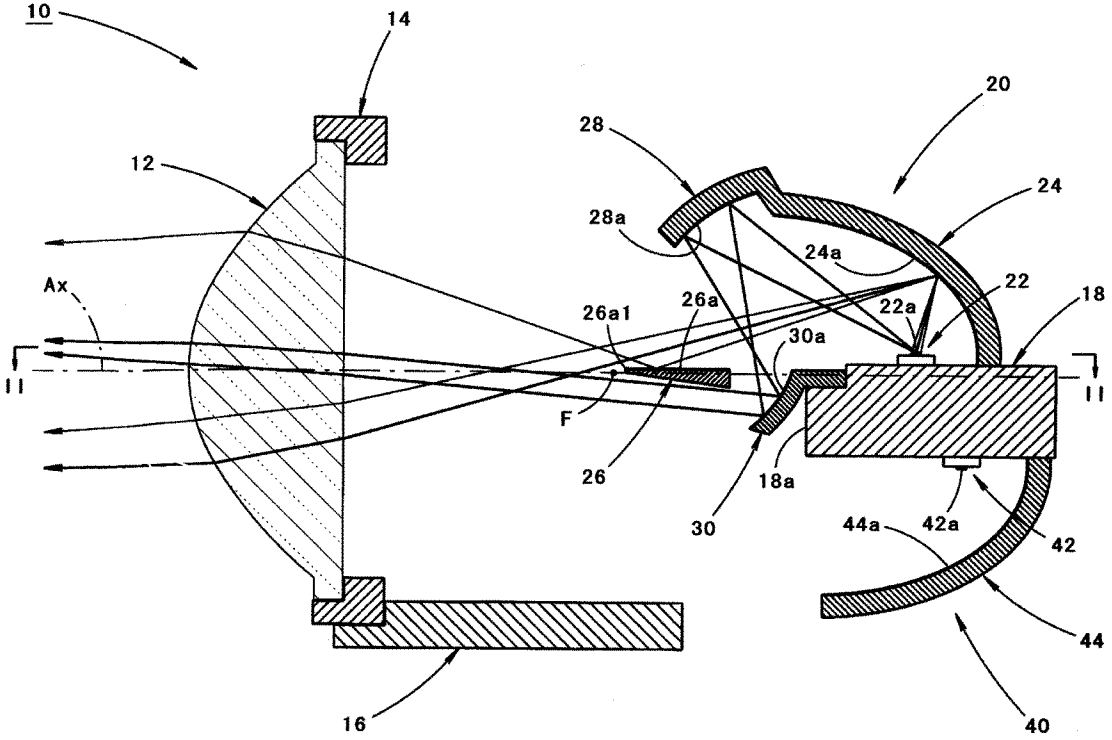
Figure 2:
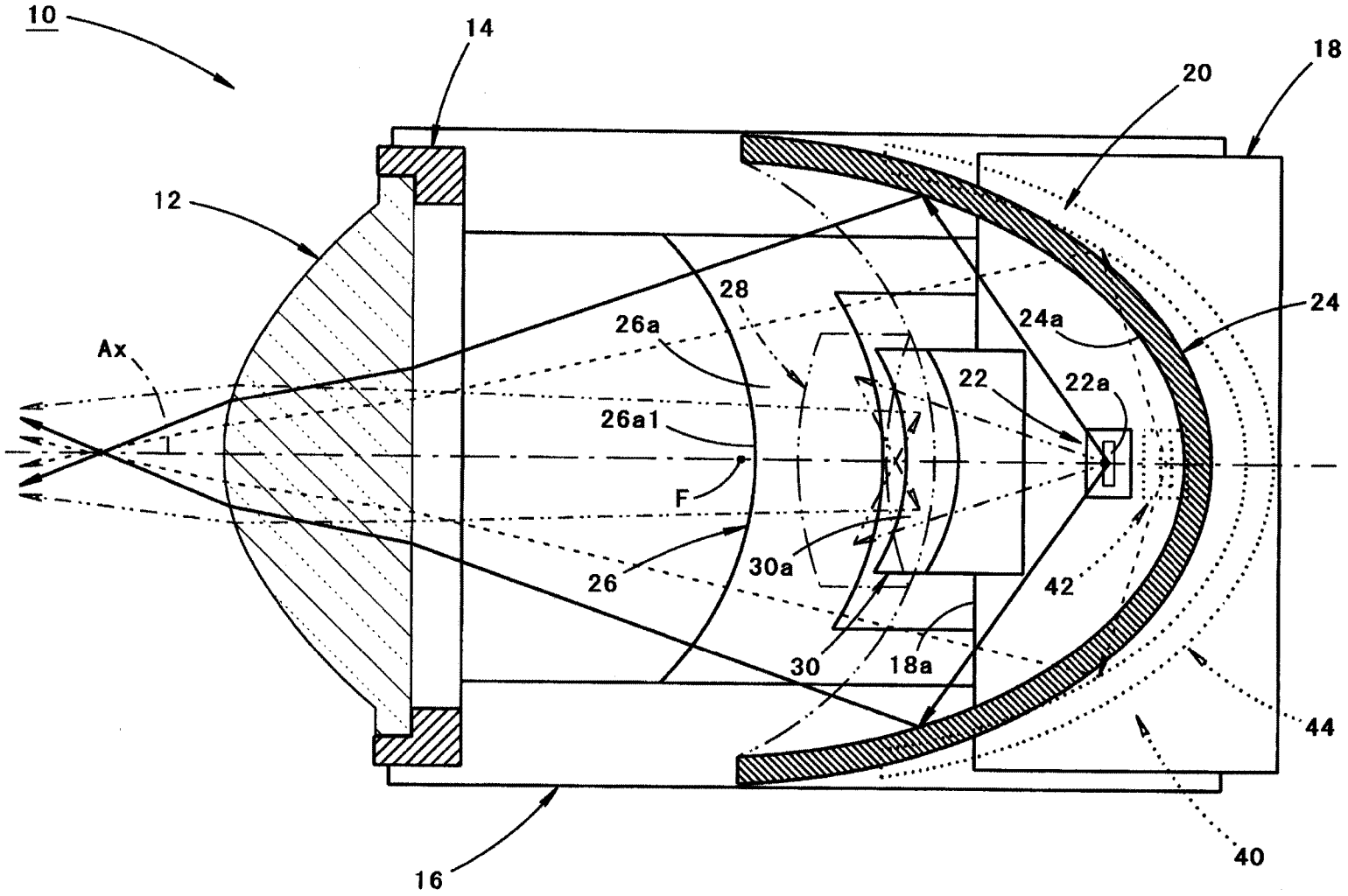
FIG. 2 is a sectional view taken along line II-II in FIG. 1.

FIG. 1 is a side-sectional view showing a vehicular headlamp 10 according to one or more embodiments of the present invention in which a first light source 22 is turned on. FIG. 2 is a sectional view taken along line II-II in FIG. 1.

As shown in these figures, the vehicular headlamp 10 according to the present embodiment is a headlamp for two-wheeled vehicles, which includes a projection lens 12 and a first and a second light source units 20 and 40 disposed rearward of the projection lens 12.

The projection lens 12 is formed of a planoconvex aspheric lens with a convex front surface and supported by a lens holder 14 so as to be disposed with an optical axis Ax of the projection lens 12 extending in a front-back direction of the vehicle. The lens holder 14 is supported by a base member 16.

First, a configuration of the first light source unit 20 will be described.

The first light source unit 20 includes the first light source 22, a first reflector 24, a shield 26, and a second and a third reflectors 28 and 30.

The first light source 22 is disposed rearward of a rear focal point F of the projection lens 12.

The first light source 22 is a white light-emitting diode with a horizontally long, rectangular light emitting surface 22*a* and is supported by a heat sink 18 with the light emitting surface 22*a* disposed slightly above the optical axis Ax so as to face upward in a vertical direction.

The first reflector 24 is configured to reflect, above the first light source 22, emitted light from the first light source 22 toward the projection lens 12.

A reflecting surface 24*a* of the first reflector 24 is defined by a generally ellipsoid-shaped curved surface with a first focal point corresponding to the center of light emission of the first light source 22. In this regard, the reflecting surface 24*a* is set such that a vertical sectional shape of the reflecting surface 24*a* including an optical axis Ax is an ellipsoid with a second focal point corresponding to a point positioned slightly forward of the rear focal point F. The reflecting surface 24*a* is also set such that the eccentricity thereof increases gradually from a vertical section thereof toward a horizontal section thereof. Thus, the first reflector 24 converges, in the vertical cross section thereof, light from the first light source 22 to the second focal point, and displaces, in the horizontal cross section thereof, the position of the convergence forward.

The first reflector 24 is supported by the heat sink 18 at a peripheral lower end of the reflecting surface 24*a*.

The shield 26 has an upward reflecting surface 26*a* extending along a horizontal surface near and above the optical axis Ax. The shield 26 is disposed such that a front end edge 26*a*1 of the upward reflecting surface 26*a* passes behind and near the rear focal point F. The front end edge 26*a*1 of the upward reflecting surface 26*a* is formed to extend from the position on the optical axis Ax toward laterally opposite sides so as to be curved forward.

The shield 26 blocks and reflects a portion of reflected light from the first reflector 24 upward at the upward reflecting surface 26*a* so that the light enters the projection lens 12. The light is then emitted from the projection lens 12 as downward light.

The shield 26 is formed as a plate-like member with a thickness increasing rearward, and the front end edge of a lower surface of the shield 26 is positioned at substantially the same height as that of the optical axis Ax. A rear end surface of the shield 26 is formed to extend, at a position forward away from a front end surface 18*a* of the heat sink 18, from the position on the optical axis Ax toward laterally opposite sides so as to be curved forward.

The shield 26 is supported by a base member 16 at laterally opposite ends of the shield 26. The shield 26 is formed such that the laterally opposite ends of the shield 26 extend rearward. Rear end surfaces of the laterally opposite ends of the shield 26 are abutted on the front end surface 18*a* of the heat sink 18 so that positioning of the shield 26 in the front-back direction is achieved.

The second reflector 28 is disposed forward of the first reflector 24 and configured to reflect emitted light from the first light source 22 toward a position between the heat sink 18 and the shield 26.

A reflecting surface 28*a* of the second reflector 28 is defined by a rotational ellipsoid with a first focal point corresponding to the center of light emission of the first light source 22 and a second focal point corresponding to a point positioned between the heat sink 18 and the shield 26 and slightly above the optical axis Ax. The second reflector 28 converges light from the first light source 22 reflected by the reflecting surface 28*a* of the second reflector 28 to the second focal point.

The second reflector 28 is formed integrally with the first reflector 24.

The third reflector 30 is disposed between the heat sink 18 and the shield 26 and configured to reflect reflected light from the second reflector 28 toward the projection lens 12 by passing the reflected light below the shield 26.

A reflecting surface 30*a* of the third reflector 30 is defined by a curved surface shaped like a rotational paraboloidal surface which has a focal point corresponding to the second focal point of the rotational ellipsoid and which slightly spreads toward laterally opposite sides. The third reflector 30 reflects reflected light from the second reflector 28 forward so that resultant light beams that are slightly upward and substantially parallel to one another pass through the vicinity of the center of the projection lens 12.

The third reflector 30 is supported by the heat sink 18 at a rear portion of the third reflector 30.

Now, a configuration of the second light source unit 40 will be described.

Figure 3:
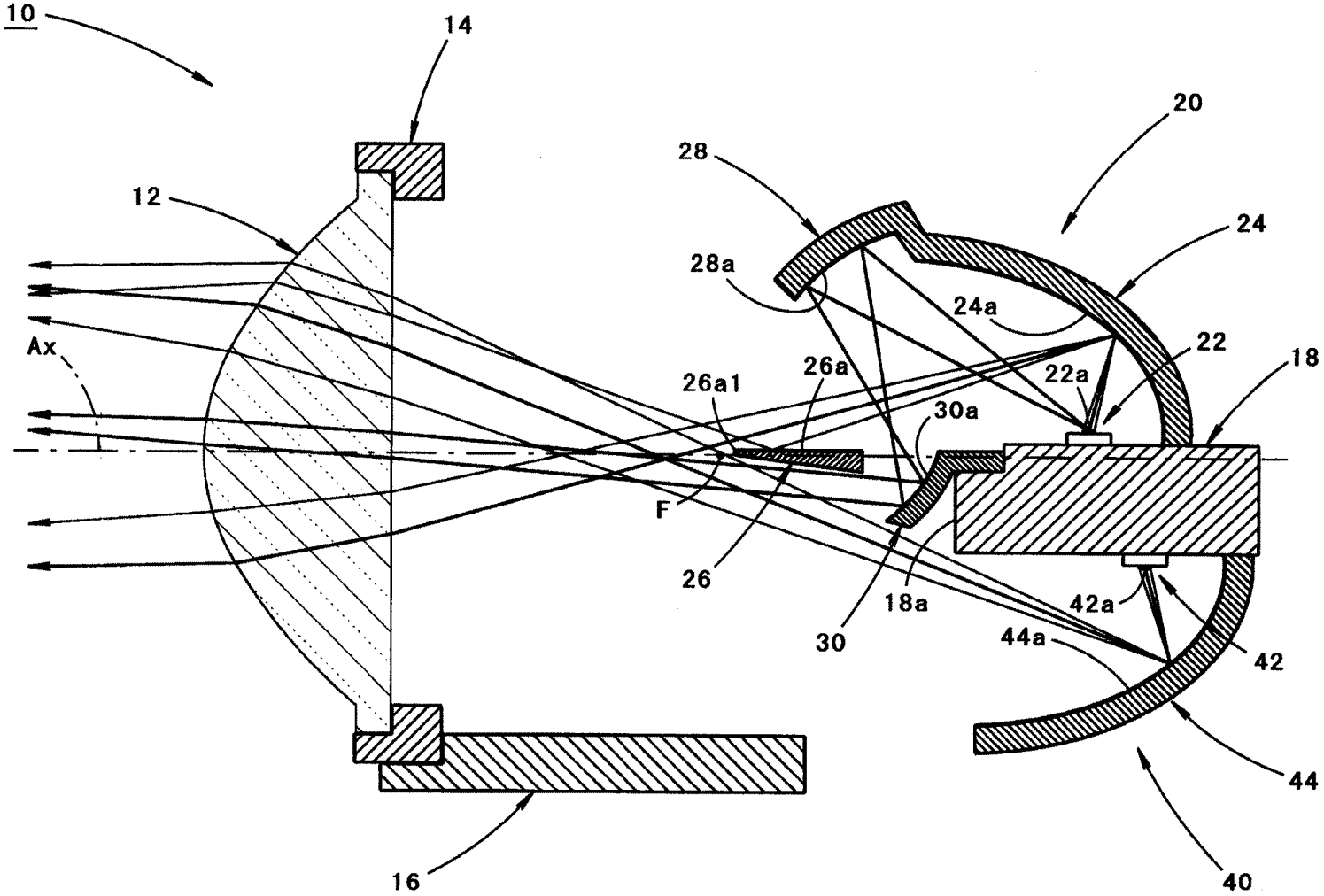

FIG. 3 is a side-sectional view showing the vehicular headlamp 10 in which the second light source 42 is additionally turned on.

As also shown in FIG. 3, the second light source unit 40 includes the second light source 42 and a fourth reflector 44.

The second light source 42 is a white light-emitting diode with a horizontally long, rectangular light emitting surface 42*a* and is supported by the heat sink 18 with the light emitting surface 42*a* disposed below the optical axis Ax and slightly rearward of the first light source 22 so as to face downward in the vertical direction.

The fourth reflector 44 is configured to reflect, below the second light source 42, emitted light from the second light source 42 toward the projection lens 12.

A reflecting surface 44*a* of the fourth reflector 44 is defined by a generally ellipsoid-shaped curved surface with a first focal point corresponding to the center of light emission of the second light source 42. The reflecting surface 44*a* is set such that a vertical sectional shape of the reflecting surface 44*a* including the optical axis Ax is an ellipsoid with a second focal point corresponding to a point positioned slightly forward of the rear focal point F. The reflecting surface 44*a* is also set such that the eccentricity thereof increases gradually from a vertical section thereof toward a horizontal section thereof. Thus, the fourth reflector 44 converges, in the vertical section thereof, light from the second light source 42 to the second focal point, and displaces, in the horizontal section thereof, the position of the convergence forward.

The fourth reflector 44 is supported by the heat sink 18 at a peripheral upper end of the reflecting surface 44*a*.

Reflected light from the fourth reflector 44 passes below the shield 26 and reaches the projection lens 12 in the form of upward reflected light. However, the position of a lower end edge of the third reflector 30 is set away from the optical path of reflected light from the fourth reflector 44. This prevents the reflected light from the fourth reflector 44 from being blocked by the third reflector 30.

Figure 4A:
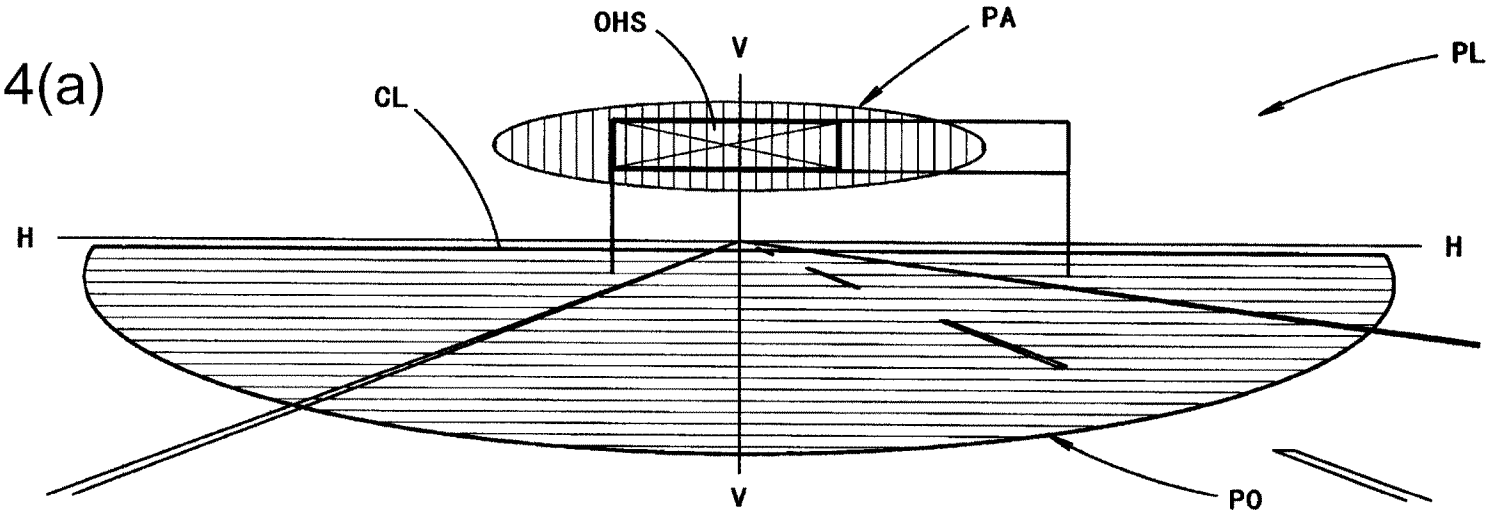
FIGS. 4(*a*)-4(*b*) are perspective views showing a light distribution pattern formed on a virtual vertical screen disposed 25 m forward of a vehicle, by light radiated forward by the vehicular headlamp.
Figure 4B:
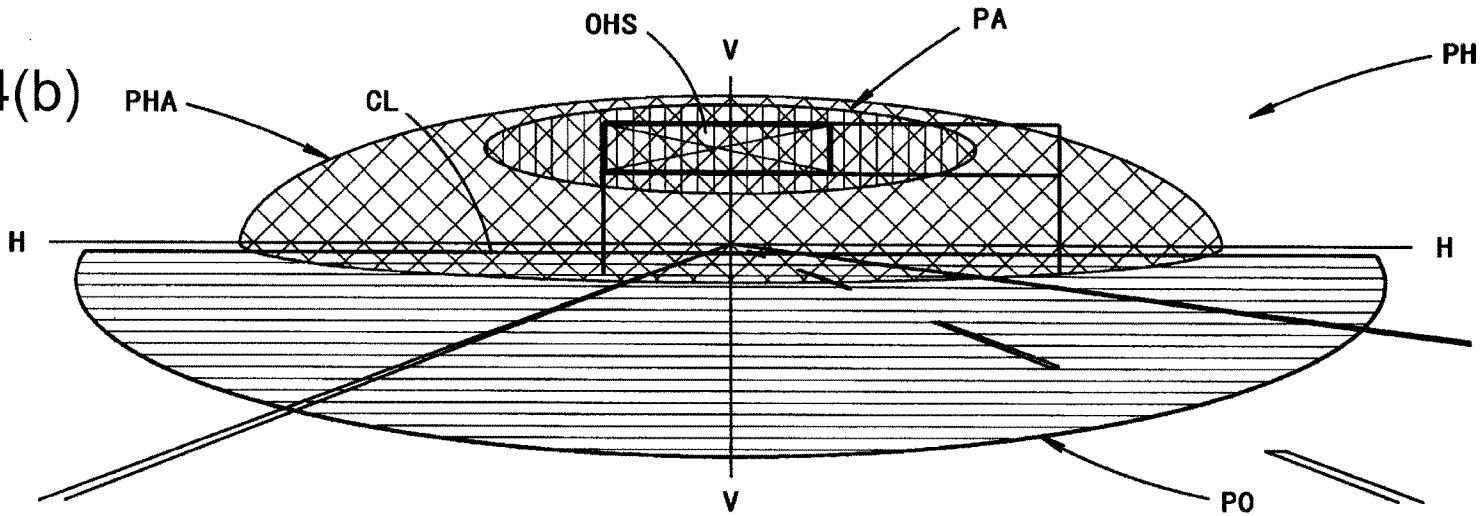

FIGS. 4(*a*)-4(*b*) are perspective views showing a light distribution pattern formed on a virtual vertical screen disposed 25 m forward of a vehicle, by light radiated forward by the vehicular headlamp 10. FIG. 4(*a*) shows a low-beam distribution pattern PL, and FIG. 4(*b*) shows a high-beam distribution pattern PL.

The low-beam distribution pattern PL shown in FIG. 4(*a*) is a light distribution pattern formed when the first light source 22 is turned on.

The low-beam distribution pattern PL includes a basic light distribution pattern P0 and an additional light distribution pattern PA.

The basic light distribution pattern P0 is a horizontally long, large light distribution pattern with a cut-off line CL at an upper end edge of the pattern, and provides a basic shape for the low-beam distribution pattern PL.

The basic light distribution pattern P0 is formed by projecting an image from the first light source 22 formed on a rear focal plane of the projection lens 12 by light from the first light source 22 reflected by the first reflector 24, on the virtual vertical screen as an inverted projection image. The cut-off line CL is formed to extend in the horizontal direction slightly below H-V that is a vanishing point in a forward direction of the lamp, as an inverted projection image of the front end edge 26*a* of the upward reflecting surface 26*a* of the shield 26.

The additional light distribution pattern PA is a light distribution pattern defined by light from the first light source 22 sequentially reflected by the second and third reflectors 28 and 30. The additional light distribution pattern PA is formed as a horizontally long light distribution pattern spreading toward laterally opposite sides around a line V-V that is a vertical line passing through H-V in a space above the cut-off line CL. The additional light distribution pattern PA allows an overhead sign OHS installed above a road surface located forward of the vehicle to be irradiated with light.

The high-beam distribution pattern PH shown in FIG. 4(*b*) is a light distribution pattern formed when the first and second light sources 22 and 42 are simultaneously turned on.

The high-beam distribution pattern PH is formed as a synthetic light distribution pattern of the low-beam distribution pattern PL and a high-beam additional light distribution pattern PHA spreading upward from the cut-off line CL of the low-beam distribution pattern PL.

The high-beam additional light distribution pattern PHA is formed as a light distribution pattern that is brighter and smaller than the basic light distribution pattern P0. The high-beam additional light distribution pattern PHA is formed such that a lower end edge thereof spreads to slightly below the cut-off line CL.

The reason why the lower end edge of the high-beam additional light distribution pattern PHA is formed to spread to slightly below the cut-off line CL is that a front end edge 26*a*1 of the upward reflecting surface 26*a* of the shield 26 is positioned behind and near the rear focal point F and the front end edge of the lower surface of the shield 26 is positioned at substantially the same height as that of the optical axis Ax.

Now, the operations of one or more embodiments of the present invention will be described below.

The vehicular headlamp 10 according to one or more embodiments the present invention is configured such that light from the first light source 22 disposed rearward of the rear focal point F of the projection lens 12 is reflected toward the projection lens 12 by the first reflector 24 disposed above the first light source 22 and such that the shield 26 disposed with the front end edge 26*a*1 thereof passing behind and near the rear focal point F blocks a portion of reflected light from the first reflector 24. Thus, the low-beam distribution pattern PL with the cut-off line CL at the upper end thereof can be formed.

Moreover, the second reflector 28 is disposed forward of the first reflector 24, which reflects emitted light from the first light source 22 toward a position between the first light source 22 and the shield 26. Meanwhile, between the first light source 22 and the shield 26, the third reflector 30 is disposed which reflects reflected light from the second reflector 28 toward the projection lens 12 by passing the reflected light below the shield 26. Thus, the additional light distribution pattern PA can be formed above the cut-off line CL by using the light sequentially reflected by the second and third reflectors 28 and 30.

Since the third reflector 30 is disposed between the first light source 22 and the shield 26 rather than forward of the shield 26, the incident angle of reflected light from the second reflector 28 entering the third reflector 30 can be restricted to a relatively small value. Thus, the direction of reflected light from the third reflector 30 can be accurately controlled, allowing the additional light distribution pattern PA to be formed with high positional accuracy.

Thus, according to one or more embodiments of the present invention, in the projector-type vehicular headlamp 10 with the shield 26, the additional light distribution pattern PA formed above the cut-off line CL can be formed with high positional accuracy.

In one or more embodiments of the present invention, reflected light from the third reflector 30 is radiated to the overhead sign OHS installed above the road surface located forward of the vehicle. Thus, the additional light distribution pattern PA is formed with high positional accuracy, allowing the visibility of the overhead sign OHS to be enhanced.

Moreover, in one or more embodiments of the present invention, the reflected light from the third reflector 30 passes through the vicinity of the center of the projection lens 12. This enables effective suppression of possible chromatic aberration in emitted light from the projection lens 12.

Furthermore, in one or more embodiments of the present invention, the second light source 42 is disposed on the rear side of the rear focal point F of the projection lens 12, and downward of the second light source 42, the fourth reflector 44 is disposed which reflects emitted light from the second light source 42 toward the projection lens 12. Thus, the high-beam distribution pattern PH can be formed by simultaneously turning on the first and second light sources 22 and 42.

Since the third reflector 30 is not disposed forward of the shield 26 unlike in the related art but is disposed between the first light source 22 and the shield 26 at the position away from the optical path of reflected light from the fourth reflector 44, the reflected light from the fourth reflector 44 can be prevented from being blocked by the third reflector 30.

Moreover, in the above-described configuration, the first and second light sources 22 and 42 are supported by the heat sink 18, which is a common light source support member, and the third reflector 30 is disposed between the heat sink 18 and the shield 26. This allows easy provision of a configuration in which the third reflector 30 is disposed at the position away from the optical path of the reflected light from the fourth reflector 44. Thus, an installation space for the third reflector 30 can be easily secured. Furthermore, the reflected light from the fourth reflector 44 can be prevented from being blocked by the third reflector 30.

In one or more of the above embodiments, the configuration of the shield 26 has been described as follows: the shield 26 is disposed such that the front end edge 26*a*1 of the upward reflecting surface 26 of the shield 26 passes behind and near the rear focal point F. However, a configuration can also be adopted in which, for example, the shield 26 is disposed such that the front end edge 26*a*1 of the reflecting surface 26 passes through the rear focal point F or above and near the rear focal point F.

In one or more of the above embodiments, the shield 26 has been described to be configured such that the upward reflecting surface 26 blocks a portion of reflected light from the first reflector 24 and reflects the portion upward. However, the shield 26 may be simply configured to block a portion of the reflected light from the first reflector 24.

In one or more of the above embodiments, the additional light distribution pattern PA is formed which allows the overhead sign OHS to be irradiated with reflected light from the third reflector 30. However, a configuration is also possible which forms another additional light distribution pattern (for example, an additional light distribution pattern extending longer than the additional light distribution pattern PA toward the laterally opposite sides in the space above the cut-off line CL).

In one or more of the above embodiments, the case has been described in which the vehicular headlamp 10 is a headlamp for two-wheeled vehicles. However, even when the vehicular headlamp 10 is a headlamp for four-wheeled vehicles, similar operations can be achieved by adopting a configuration similar to the configuration of one or more of the above embodiments.

Now, a modification of the above-described embodiment will be described.

First, a first modification will be described.

Figure 5:
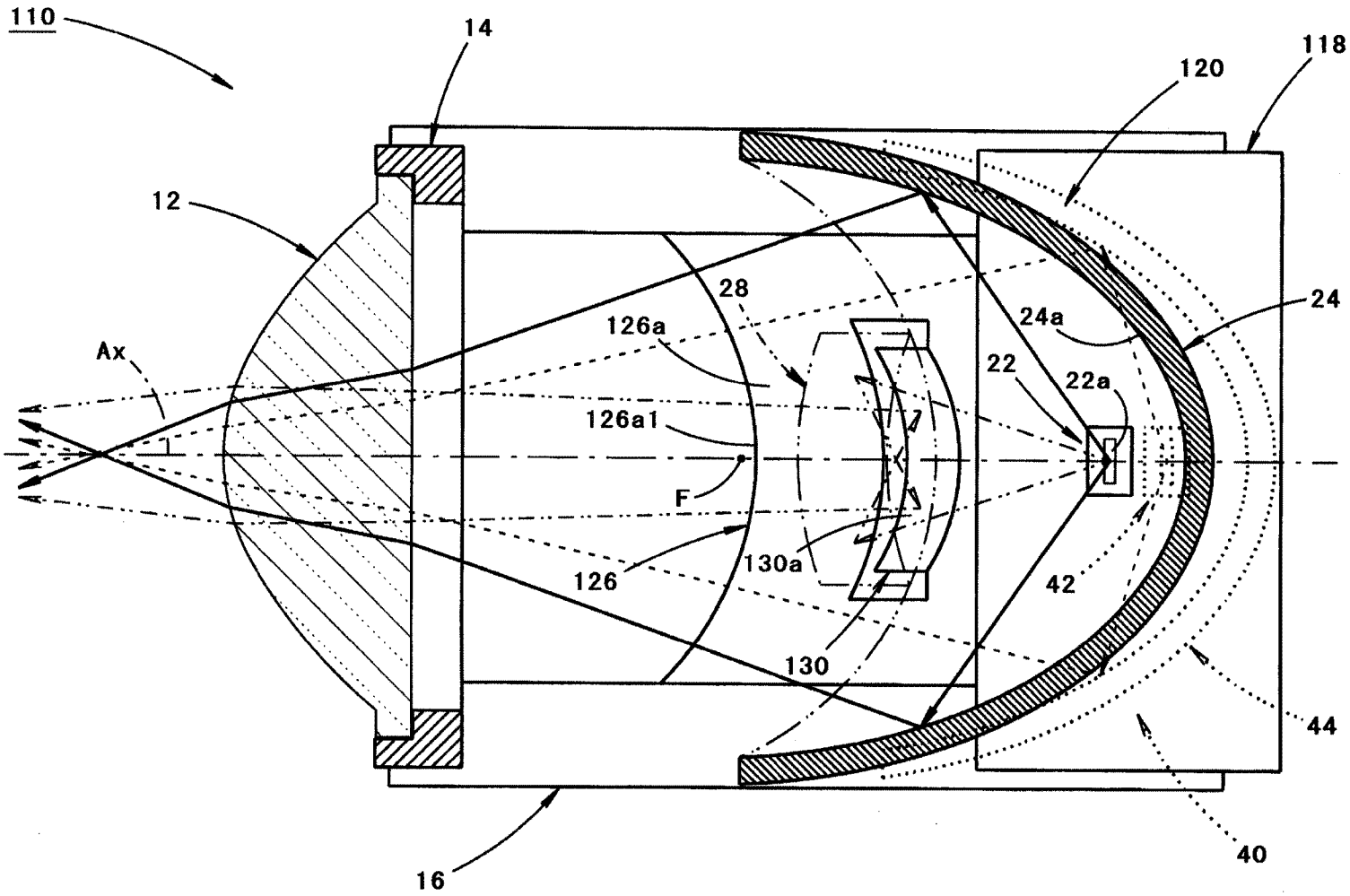
FIG. 5 is a view which is similar to FIG. 2 and which shows a first modification.

FIG. 5 is a view which is similar to FIG. 2 and which shows a vehicular headlamp 110 according to the first modification.

As shown in FIG. 5, a basic configuration of the present modification is similar to the configuration of one or more of the above embodiments. However, a configuration of a first light source unit 120 is partly different from the corresponding configuration in one or more of the above embodiments.

That is, in the first modification, a third reflector 130 is formed integrally with a shield 126.

A reflecting surface 130*a* of the third reflector 130 has a configuration similar to the configuration of the reflecting surface 30*a* of the third reflector 30.

In the first modification, the third reflector 130 is not supported by a heat sink 118. Thus, the shape of the heat sink 118 is partly different from the corresponding shape in one or more of the above embodiments.

Operations similar to those of one or more of the above embodiments can be achieved when the configuration of the first modification is adopted.

Furthermore, the adoption of the configuration in the first modification enhances the accuracy of the positional relationship between a front end edge 126*a*1 of a reflecting surface 126*a* of the shield 126 and the reflecting surface 130*a* of the third reflector 130. This enables the additional light distribution pattern PA allowing the overhead sign OHS to be irradiated with light to be formed with higher positional accuracy.

Moreover, the adoption of the configuration in the first modification enables a reduction in the number of components.

Now, a second modification will be described.

Figure 6:
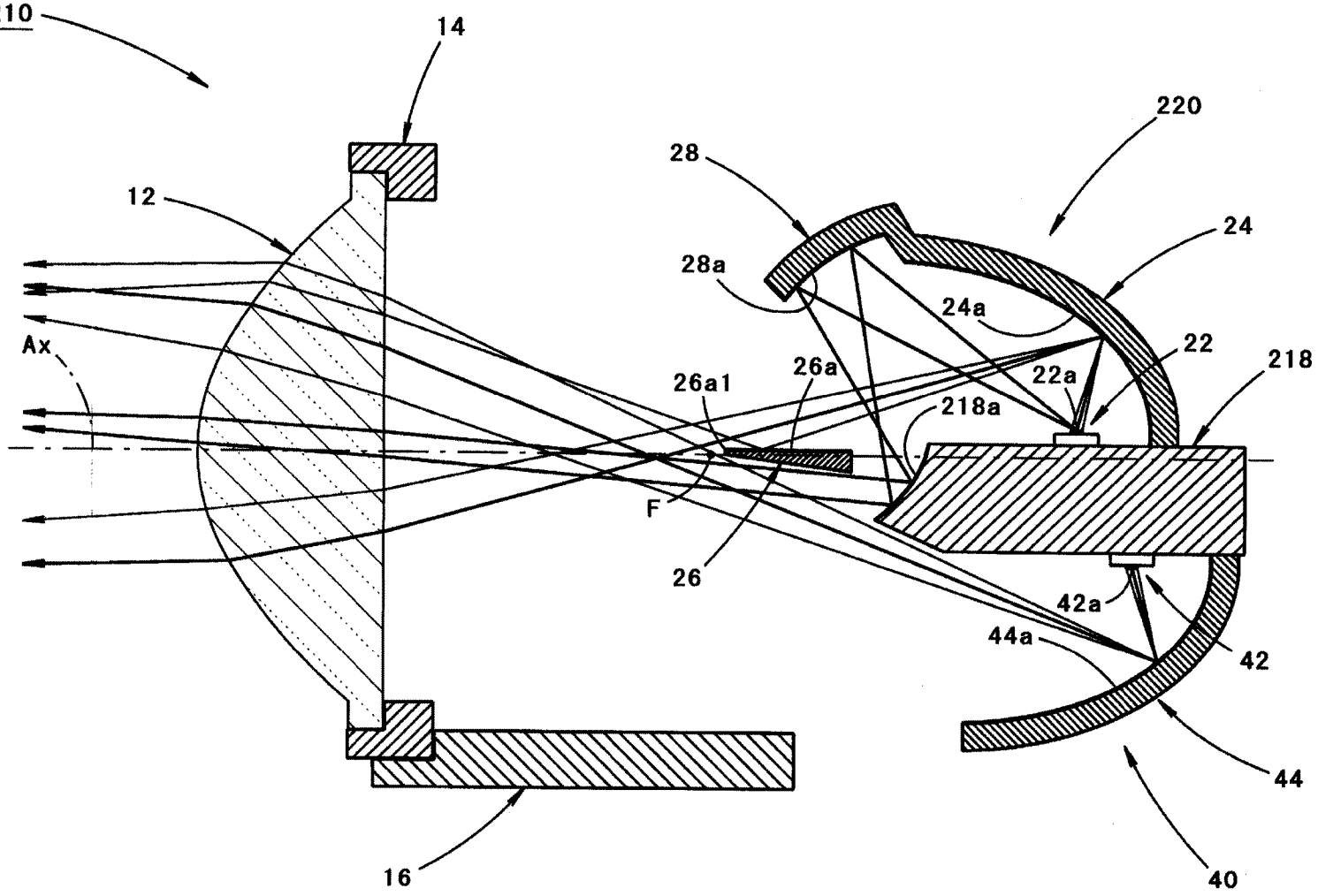
FIG. 6 is a view which is similar to FIG. 3 and which shows a second modification.

FIG. 6 is a view which is similar to FIG. 3 and which shows a vehicular headlamp 210 according to the second modification.

As shown in FIG. 6, a basic configuration of the present modification is similar to the configuration of one or more of the above embodiments. However, a configuration of a first light source unit 220 is partly different from the corresponding configuration in one or more of the above embodiments.

That is, in the second modification, a heat sink 218 is provided with a reflecting surface 218*a* corresponding to the reflecting surface 30*a* of the third reflector 30 in one or more of the above embodiments. The position and shape of the reflecting surface 218*a* are similar to the corresponding position and shape in one or more of the above embodiments.

Operations similar to those of one or more of the above embodiments can be achieved when the configuration of the second modification is adopted.

Furthermore, the adoption of the configuration in the second modification allows a formation space for the reflecting surface 218*a* to be easily secured.

Moreover, the adoption of the configuration according to the second modification enables a reduction in the number of components.

The numerical values illustrated in the above-described embodiments and modifications as specifications are only examples and may of course be set to different values as needed.

Furthermore, the present invention is not limited to the configurations described in the above-described embodiments and modifications. Other configurations with various changes made thereto may be adopted.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF THE REFERENCE NUMERALS

10, 110, 210 VEHICULAR HEADLAMP
12 PROJECTION LENS
14 LENS HOLDER
16 BASE MEMBER
18, 118, 218 HEAT SINK (LIGHT SOURCE SUPPORT MEMBER)
18*a* FRONT END SURFACE
20, 120, 220 FIRST LIGHT SOURCE UNIT
22 FIRST LIGHT SOURCE
22*a*, 42*a* LIGHT EMITTING SURFACE
24 FIRST REFLECTOR
24*a*, 28*a*, 30*a*, 44*a*, 126*a*, 130*a*, 218*a* REFLECTING SURFACE
26, 126 SHIELD
26*a*, 126*a* UPWARD REFLECTING SURFACE
26*a*1, 126*a*1 FRONT END EDGE
28 SECOND REFLECTOR
30, 130 THIRD REFLECTOR
40 SECOND LIGHT SOURCE UNIT
42 SECOND LIGHT SOURCE
44 FOURTH REFLECTOR
Ax OPTICAL AXIS
CL CUT-OFF LINE
F REAR FOCAL POINT
OHS OVERHEAD SIGN
PA ADDITIONAL LIGHT DISTRIBUTION PATTERN
PH HIGH-BEAM DISTRIBUTION PATTERN
PHA HIGH-BEAM ADDITIONAL LIGHT DISTRIBUTION PATTERN
PL LOW-BEAM DISTRIBUTION PATTERN
P0 BASIC LIGHT DISTRIBUTION PATTERN

What is claimed is:

1. A vehicular headlamp comprising:
a projection lens;
a first light source disposed rearward of a rear focal point of the projection lens;
a first reflector that reflects emitted light from the first light source above the first light source and toward the projection lens;
a shield disposed such that a front end edge of the shield passes through a vicinity of the rear focal point to block a portion of reflected light from the first reflector;
a second reflector that is disposed forward of the first reflector, and that reflects the emitted light from the first light source toward a position between the first light source and the shield; and
a third reflector that is disposed between the first light source and the shield, and that reflects reflected light from the second reflector toward the projection lens by passing the reflected light below the shield.

2. The vehicular headlamp according to claim 1, wherein the third reflector reflects light to irradiate an overhead sign installed above a road surface located forward of a vehicle.

3. The vehicular headlamp according to claim 1, further comprising:
a second light source disposed rearward of the rear focal point; and
a fourth reflector disposed downward of the second light source to reflect emitted light from the second light source toward the projection lens.

4. The vehicular headlamp according to claim 1, further comprising:
a second light source,
wherein the first and second light sources are supported by a common light source support member, and
wherein the third reflector is disposed between the light source support member and the shield.

5. The vehicular headlamp according to claim 2, further comprising:
a second light source disposed rearward of the rear focal point; and
a fourth reflector disposed downward of the second light source to reflect emitted light from the second light source toward the projection lens.

6. The vehicular headlamp according to claim 1,
wherein the shield is disposed such that the front end edge of the shield partially surrounds the rear focal point to block the portion of reflected light from the first reflector.

* * * * *